US010068558B2

(12) United States Patent
Polak

(10) Patent No.: US 10,068,558 B2
(45) Date of Patent: Sep. 4, 2018

(54) METHOD AND INSTALLATION FOR PROCESSING A SEQUENCE OF SIGNALS FOR POLYPHONIC NOTE RECOGNITION

(71) Applicant: Uberchord UG (Haftungsbeschränkt) I.G., Berlin (DE)

(72) Inventor: Martin Polak, Neu St. Johann (CH)

(73) Assignee: Uberchord UG (Haftungsbeschränkt) I.G., Berlin (DE)

( * ) Notice: Subject to any disclaimer, the term of this patent is extended or adjusted under 35 U.S.C. 154(b) by 0 days.

(21) Appl. No.: 15/534,619

(22) PCT Filed: Dec. 10, 2015

(86) PCT No.: PCT/EP2015/079205
§ 371 (c)(1),
(2) Date: Jun. 9, 2017

(87) PCT Pub. No.: WO2016/091994
PCT Pub. Date: Jun. 16, 2016

(65) Prior Publication Data

US 2017/0365244 A1 Dec. 21, 2017

(30) Foreign Application Priority Data

Dec. 11, 2014 (EP) ..... 14197438

(51) Int. Cl.
*G10H 1/18* (2006.01)
*G10H 1/12* (2006.01)
*G10H 1/38* (2006.01)

(52) U.S. Cl.
CPC ..... *G10H 1/125* (2013.01); *G10H 1/383* (2013.01); *G10H 2210/051* (2013.01); *G10H 2210/066* (2013.01); *G10H 2250/00* (2013.01)

(58) Field of Classification Search
CPC ..... G10H 2210/076; G10H 2250/031; G10H 2210/051; G10H 2210/056; G10H 2210/031; G10H 1/02
See application file for complete search history.

(56) References Cited

U.S. PATENT DOCUMENTS 6,323,412 B1 * 11/2001 Loo ..... G10H 1/40 84/636
7,672,842 B2 * 3/2010 Ramakrishnan ..... G10L 15/02 381/94.2

(Continued)

FOREIGN PATENT DOCUMENTS

EP 2 779 155 9/2014
GB 2 491 000 11/2012
WO WO 2016091994 A1 * 6/2016 ..... G10H 1/00

OTHER PUBLICATIONS

International Search Report and Written Opinion for International Application No. PCT/EP2015/079205 dated Apr. 5, 2016.

(Continued)

*Primary Examiner* — Marlon Fletcher
(74) *Attorney, Agent, or Firm* — Wolf, Greenfield & Sacks, P.C.

(57) ABSTRACT

This is a method and installation in which a time-domain digital audio signal is split into a plurality of narrow-band time-domain digital audio signals confined to specific frequency bands, short-term segments of which are temporarily stored in memory. The method comprises the use of signal processing algorithms for extracting multiple signal features from said short-term segments in a fixed sequence or upon request from a decision-making algorithm. Said decision-making algorithm makes tentative or final decisions about the type of occupancy of frequency bands resulting from the extracted features. Said decision-making algorithm may request from said signal processing algorithms further spe- (Continued)

cific feature extractions from specific short-term segments and make further tentative or final decisions about the type of occupancy of frequency bands resulting from the requested features. Next, said decision-making algorithm stores its tentative decisions and makes final decisions about band occupancy for processing together with results from later short-term segments. Eventually, said decision-making algorithm outputs final decisions derived from current and past short-segments in the form of a set of notes having been played over some recent time interval, together with information as to the timing of each note from the set.

10 Claims, 7 Drawing Sheets

(56) References Cited

U.S. PATENT DOCUMENTS 7,953,230 B2 * 5/2011 Nadjar ..... A61B 7/04 381/67
8,168,877 B1 5/2012 Rutledge et al.
8,438,033 B2 * 5/2013 Tamura ..... G10L 13/033 381/54
8,634,578 B2 * 1/2014 Vickers ..... H04R 3/04 381/104
9,640,156 B2 * 5/2017 Neuhauser ..... G10L 25/24
9,685,155 B2 * 6/2017 Hershey ..... G10L 15/16
9,830,896 B2 * 11/2017 Wang ..... G10H 1/40
2001/0045153 A1 * 11/2001 Alexander ..... G10H 3/125 84/609
2006/0056641 A1 * 3/2006 Nadjar ..... A61B 7/04 381/67
2006/0065102 A1 * 3/2006 Xu ..... G06F 17/30743 84/600
2006/0075881 A1 4/2006 Streitenberger et al.
2008/0040123 A1 2/2008 Shishido
2009/0193959 A1 * 8/2009 Mestres ..... G10H 1/0008 84/609
2010/0211200 A1 * 8/2010 Kobayashi ..... G06T 13/205 700/94
2011/0305345 A1 * 12/2011 Bouchard ..... G10L 21/0208 381/23.1
2012/0128177 A1 * 5/2012 Truman ..... G10L 21/038 381/94.3
2013/0022223 A1 * 1/2013 Kehtarnavaz ..... H04R 25/70 381/317
2013/0287225 A1 * 10/2013 Niwa ..... G10L 21/0232 381/92
2014/0161281 A1 * 6/2014 Nackvi ..... H03G 5/165 381/98
2014/0180673 A1 * 6/2014 Neuhauser ..... G10L 19/018 704/9
2014/0180674 A1 * 6/2014 Neuhauser ..... G10L 25/81 704/9
2014/0180675 A1 * 6/2014 Neuhauser ..... G06F 17/28 704/9
2014/0358265 A1 * 12/2014 Wang ..... G10H 1/40 700/94
2015/0117649 A1 * 4/2015 Nesta ..... H04R 3/005 381/17
2016/0029120 A1 * 1/2016 Nesta ..... H04M 9/082 381/66
2016/0157014 A1 * 6/2016 Van Schyndel ..... H04R 3/007 381/55
2017/0358283 A1 * 12/2017 Neuhauser ..... G10L 25/84
2017/0365244 A1 * 12/2017 Polak ..... G10H 1/125
2018/0033416 A1 * 2/2018 Neuhauser ..... G10L 15/1815

OTHER PUBLICATIONS

International Preliminary Report on Patentability for International Application No. PCT/EP2015/079205 dated Jun. 22, 2017.

* cited by examiner

METHOD AND INSTALLATION FOR PROCESSING A SEQUENCE OF SIGNALS FOR POLYPHONIC NOTE RECOGNITION

RELATED APPLICATIONS

This application is a national stage filing under 35 U.S.C. § 371 of International/PCT Application No. PCT/EP2015/079205, filed Dec. 10, 2015, which claims priority to European Patent Application No. EP 14197438.6, filed Dec. 11, 2014, each of which is incorporated herein by reference in its entirety.

FIELD OF THE INVENTION

The present invention relates to the task of identifying notes in a music signal by a method for processing a sequence of signals. More specifically, the invention relates to a method and installation for the recognition of polyphonic notes from a musical signal being captured or played back, of multiple notes being played simultaneously and consecutively.

DESCRIPTION OF THE RELATED ART

Especially since the introduction of digital audio technology and of techniques for digitally processing digital audio signals, there have been many developments aimed at identifying, out of a digital signal, which sequences of single or multiple notes are being played. In many applications, such as when a computer program is used to assist a music student in playing an instrument, an additional requirement is to perform this identification in real time, with a moderate latency, and with a high level of reliability.

In present-day solutions to the problem of identifying notes in an audio signal, a sequence of digitally coded samples is used to represent the audio signal. The task of note identification thus is that of extracting from a sequence of digital samples signal characteristics pointing to the momentary presence of musical notes, in the presence of unwanted noise caused by ambient sound and by the instrument being played.

It is well-known that, for most instruments, any given, ongoing musical note can be described over a short observation period as a time-varying sum of a sinusoidal oscillation at a fundamental frequency and several sinusoidal oscillations at harmonic frequencies, the value of each harmonic frequency being some integer times the value of the fundamental frequency, and each oscillation featuring an instantaneous amplitude and phase.

It is common in the art to select consecutive groups of samples and to analyse their spectral content in the frequency domain with a discrete Fourier transform. This transform yields a number of complex or real values which can be used to characterize, equivalently, the amplitude or the amount of signal energy present in equidistant, constant-width spectral bands. Spectral bands with low energy with respect to total energy and to the energy of neighbouring bands are considered to be empty, whereas spectral bands with significant energy are identified and characterized as peaks. The peak frequency associated with each peak, often defined as either the arithmetic average of the lower and upper cut-off frequencies or as their geometrical average, is then used for further processing, and musical note detection becomes the task of finding which patterns of fundamentals and harmonics generated by a possible combination of notes best matches the pattern of such peak frequencies.

In the following, the state of the art is further discussed based on three references, namely these documents:

Ref. 1: Patent U.S. Pat. No. 8,592,670 Polyphonic Note Detection.

Ref. 2: Judith C. Brown and Miller S. Puckette, An efficient algorithm for the calculation of a constant Q transform, J. Acoust. Soc. Am. 92(5):2698-2701 (1992).

Ref. 3: R. C. Maher and J. W. Beauchamp, "Fundamental frequency estimation of musical signals using a two-way mismatch procedure", J. Acoust. Soc. Am. 94(4), 2254-2263 (1994).

Ref. 1 is a recent example of such a method for polyphonic note detection. The above method, though quite straightforward, is often made ineffective for reasons directly related to the behaviour of fundamentals and harmonics in the time domain. For example, it is common for a chord to include two notes precisely one octave apart. In such a case, the second harmonic of the lower note will be in the same frequency band as the fundamental of the higher note. This makes the detection of the fundamental of the higher notes more difficult as itself and all its harmonics will be in frequency bands also occupied by harmonics of the lower note. In addition, spectral components originating from both notes and presents in the same frequency band will display the well-known phenomenon of beats, in which two sinusoidal oscillations with a small difference in frequency will alternately reinforce or partially cancel each other. Thus, over a short period of time, it is quite possible for a band to appear nearly empty and thus to not be identified as a peak.

Because a straightforward Fourier transform performs an instantaneous frequency analysis based on equidistant bands, whereas the common definition of notes, as well as many psycho acoustical effects, are based on a logarithmic frequency scaling, a variant of frequency domain analysis is often used by persons of the art which performs Fourier transformation on the basis of bands with a constant relative bandwidth as opposed to an absolute one, as illustrated by Ref. 2. When this method is applied to note recognition, it is common practice to compute the energy present in the frequency bands over a short time interval and to then define frequency peaks, which now relate to non-equidistant frequency bands as opposed to the equidistant frequency bands of conventional Fourier analysis. However, the same fundamental disadvantages encountered in the case of multiple occupancy of individual bands by spectral components originating from different notes obviously remains.

Components originating from different notes and occurring simultaneously within a given individual band can be subject to a more precise analysis, for example by increasing the resolution provided by the frequency analysis. This can be achieved by significantly increasing the number of frequency bands, though with the disadvantage of simultaneously increasing the number of samples to be processed by the Fourier transform, which in turn increases the response time of the detection method.

There exists, therefore, a considerable interest in developing methods for musical note and chord detection providing accurate, detailed and reliable decisions as to whether a given band is occupied either by noise only or by two signals of significant amplitude in short term cancellation, as well as a better decision as to whether a given band is occupied either by one single signal of significant amplitude or by several such signals.

One feature common to all methods for note detection encountered so far relates to information reduction. A Fourier transform as described in Ref. 1 and involving consecutive time segments of the audio signal computes for each band an average of the energies of the frequency components present in each band. This also holds true for another type of processing also well known to people of the art as described in Ref. 2 which combines a Fourier transform with band specific window functions and yielding a spectral analysis with non-uniform frequency bands. This transform also operates over one segment of the input signal, then the next segment of the same length of the input signal, etc. and its output also corresponds to an average of the energies of the frequency components present in a specific band.

Similarly, splitting a signal into frequency bands and computing the signal energy present within each band over some time interval for further processing is equivalent to computing an average before proceeding with further processing. In both cases, peaks are defined on the basis of short-term signal averages, and subsequent decisions on possible notes and combinations of notes are made either by taking solely into account the peak frequencies, or, as is occasionally done, see Ref. 3, by also taking into account the energy values of the peaks. In other words, decisions are made after a very significant reduction (through averaging) of the information present in the frequency bands.

It is therefore a natural next step in sophistication and effectiveness, though one which has not been encountered in any existing solution to the problem of note and chord detection, to define peaks by algorithmic methods which refrain from reducing existing information solely to peak energies, thus allowing further processing of band signal properties for the sake of resolving ambiguities in band occupancy or for that of detection accuracy. Another further and natural step in sophistication and effectiveness, and again one which has not been encountered in any existing solution to the problem of note and chord detection, is to avoid an initial binary allocation of frequency bands to either non-peaks or peaks, and to make decisions based on the extraction of several types of short-term features from all bands, thus allowing for a much more robust decision-making process based on a much greater amount of information. In both those further natural steps, it is important to make sure that the additional processing steps do not unduly increase latency, i,e, the time required to reach a decision as to which notes, if any, were being played in the time interval under consideration.

SUMMARY OF THE INVENTION

The present invention solves the problem of determining which notes are being played on a polyphonic instrument, based on a short term, low latency analysis of the acoustic signal generated by the instrument or of signals derived from it.

It is an object of the invention to take into account as much of the available information as possible for as long as possible along the decision process, as opposed to discarding a significant amount of information early in the decision process.

It is yet another object of the invention to make possible whenever appropriate a detailed analysis of all available information in order to resolve under the best possible conditions cases of band occupancy by harmonics and all of fundamentals which could not be resolved on the basis of a simple peak definition only.

It is also an object of the invention to make possible the use of algorithms leading to a fast, reliable and accurate resolution for most of the cases of band occupancy encountered under normal playing conditions.

It is yet another object of the invention to make possible the use of algorithms which do not have a significant impact on the overall computational complexity of polyphonic note detection, as this is an important boundary condition in the implementation of real-time, almost instantaneous polyphonic note detection in such contexts as the software assisted learning of a musical instrument.

Embodiments of the present invention overcome the difficulties described in the background of the invention because, rather than discarding detection-relevant information prior to making decisions on the best possible fit between a hypothetical set of notes and the observed data, the method of the present invention preserves all available information over the full length of the time interval with respect to which a decision has to be taken, this being equally true for bands displaying significant energy and for bands with a much lower energy.

It is a further object of the invention to apply similar methods for the recognition of notes being played, for the recognition of those phases when new notes start being played (the short time intervals commonly referred to in the art as "onset"), and for the ongoing recognition of the precise tuning of the instrument being played.

In the following the method will be explained and described by way of examples relating to the following figures, which show:

FIG. 1 describes individual oscillations a represented by spectral lines;

FIG. 2 beats which can be observed within one specific narrow band occupied by two spectral lines;

FIG. 3 The steps of a Fourier transform processing from signals to notes;

FIG. 4 A signal processing from signals to notes using a bank of narrow-band band-pass filters;

FIG. 5 An improved method for processing signals to notes using individual time sequences of signals confined to each individual band, which are stored temporarily in order for a single feature or a plurality of features to be extracted from the signals being stored in memory, either in a fixed sequence or upon request from a decision-making algorithm;

FIG. 6 A specific implementation of this mechanism according to FIG. 5 in which a short segment of the time domain output of a given frequency band is processed in order to approximate its signal envelope and to extract a frequency measurement from the signal segment's zero crossings;

FIG. 7 represents the overall logical structure of a processor for implementing the invention.

DETAILED DESCRIPTION OF THE INVENTION

Figure 1:
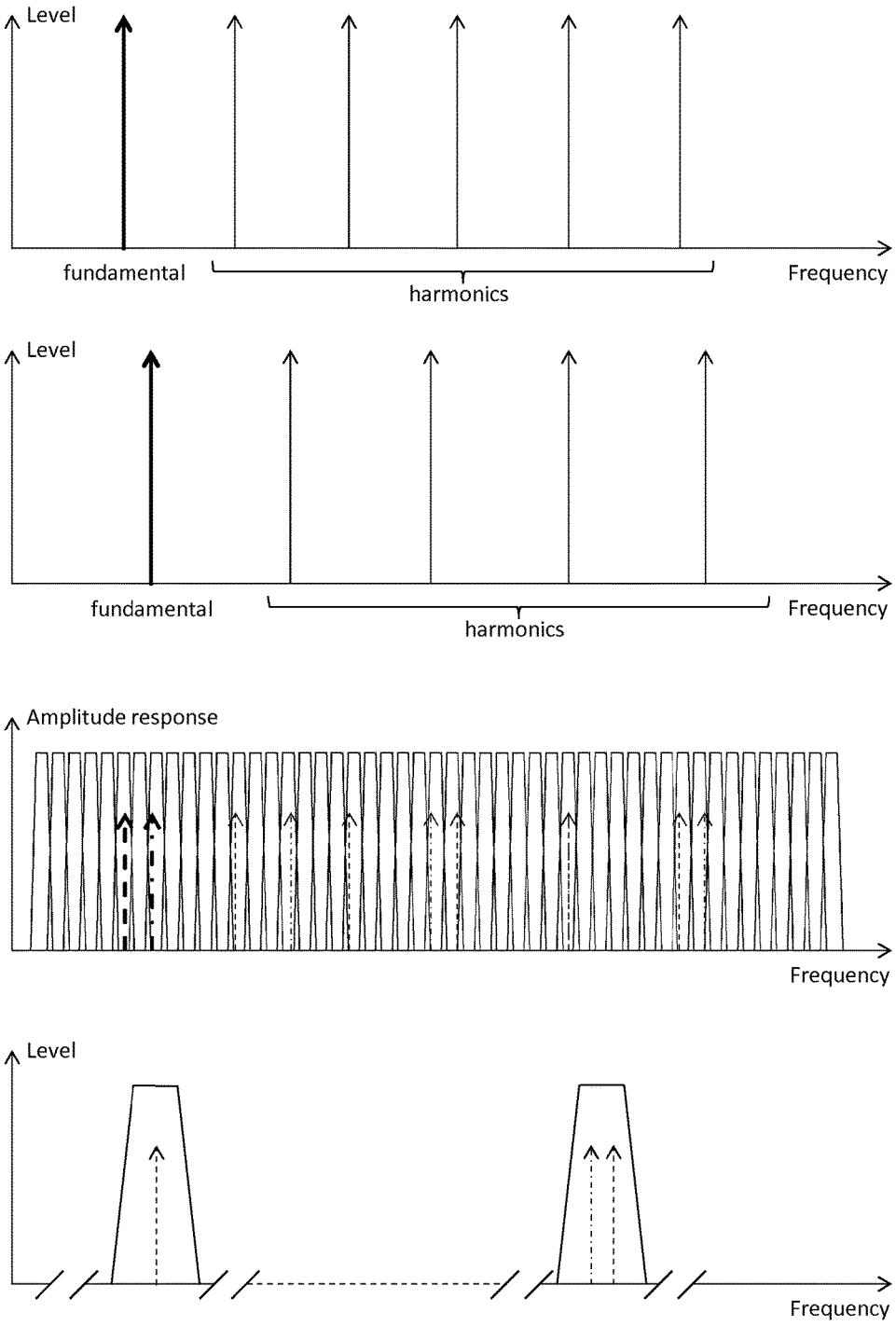
FIG. 1 describes a situation in which a first note being played is represented by the sum of a fundamental oscillation and a number of harmonic oscillations, and a second note being played simultaneously is also represented by the sum of another fundamental oscillation and a number of harmonic oscillations. The individual oscillations are represented by spectral lines, and some frequency bands can be occupied by spectral lines originating from both the first and the second note.
Figure 2:
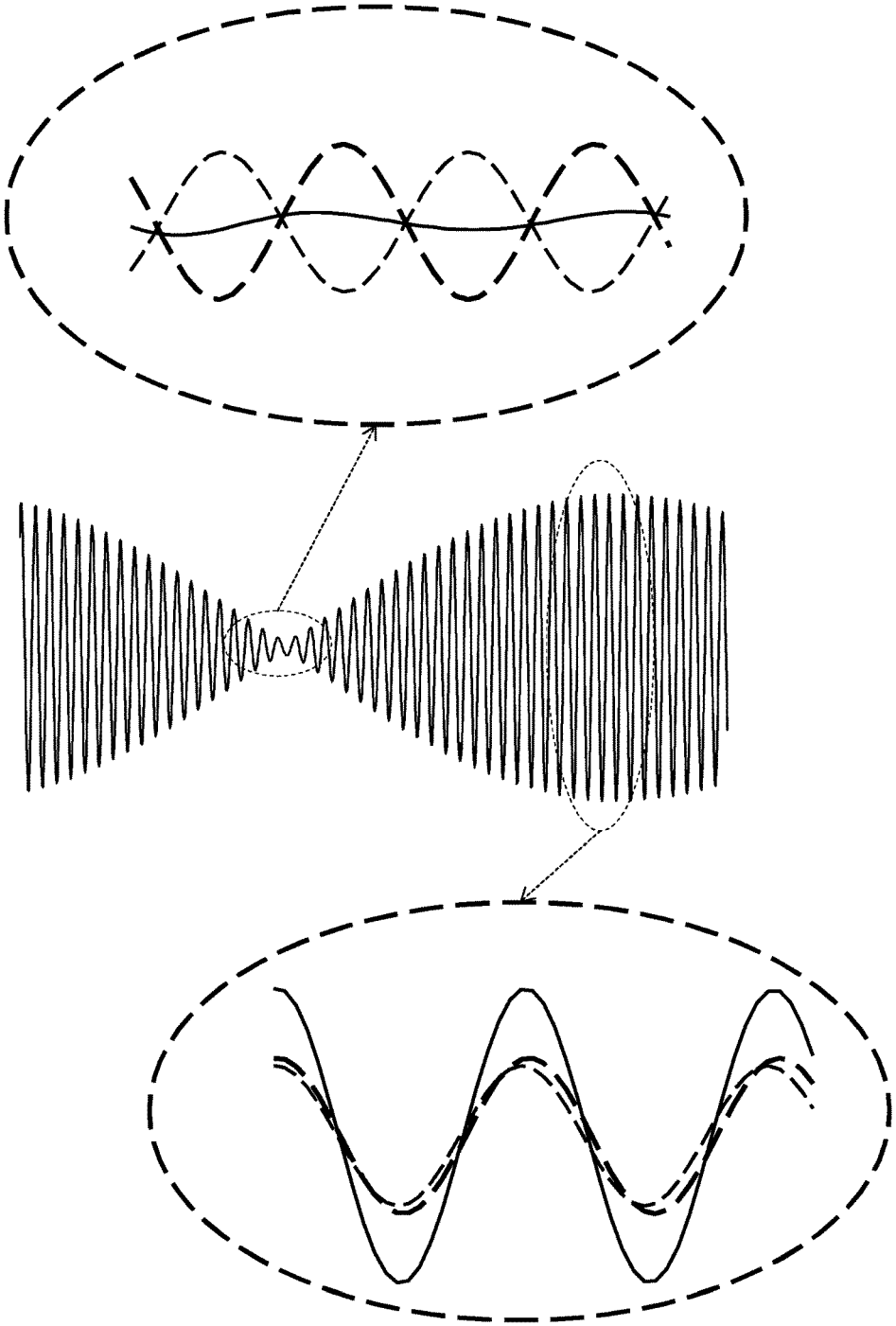
FIG. 2 describes the phenomenon of beats which can be observed within one specific narrow band occupied by two spectral lines with a small difference in frequency (consistent with the narrow bandwidth of the frequency band) and with approximately similar amplitudes.
Figure 3:
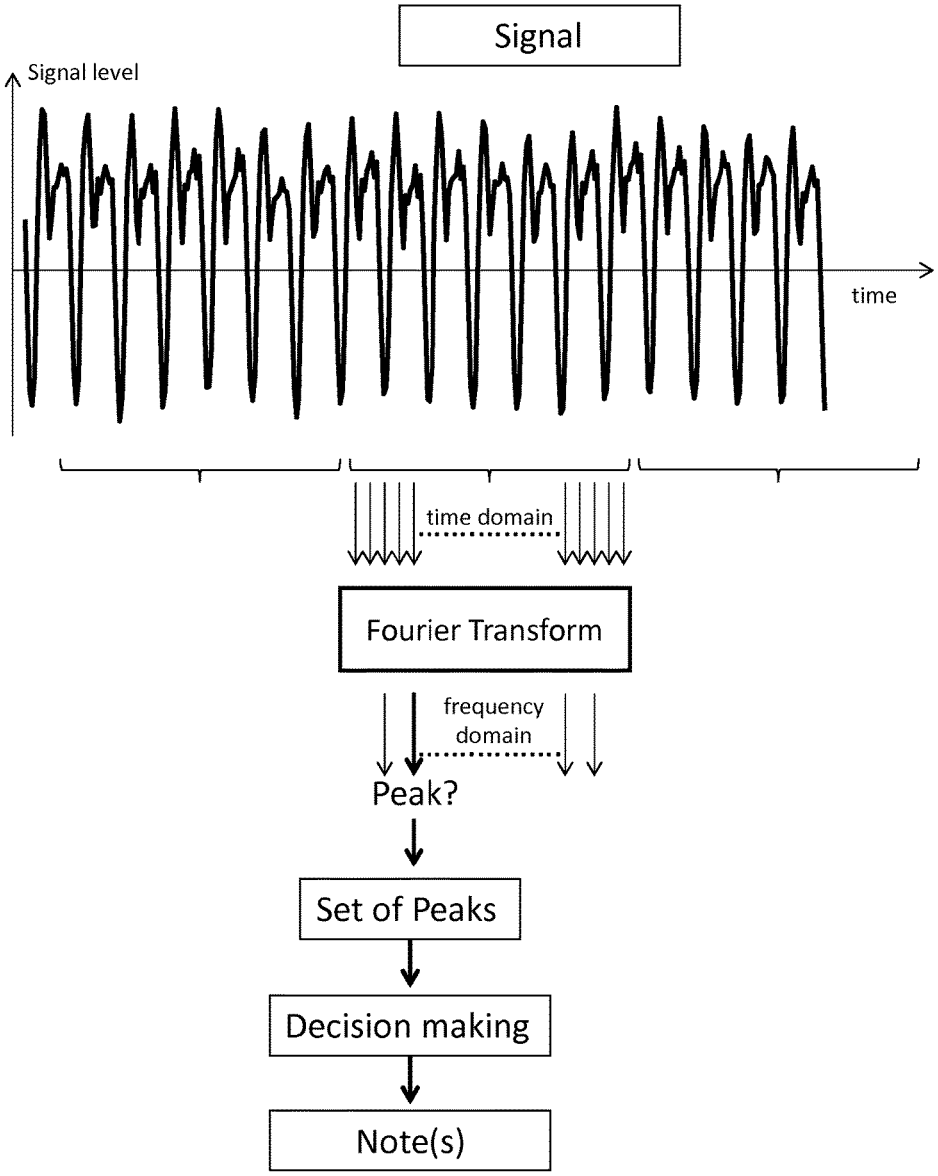
FIG. 3 describes the mechanism by which taking the Fourier transform (windowed or not) of a finite-length segment of a digital audio signal, then taking the same Fourier transform of the following, adjacent finite length segment of the digital signal etc. yields, in each band, one single number for each finite length segment of the digital signal representing the power of all contributions of the input signal to this particular band. In other words, there is a significant information reduction in performing the Fourier transform on contiguous segments and in using one single number to characterize the conditions within a given band. In other words, deciding for each band one time per segment whether it can be defined as a peak or not and only processing the position in the frequency domain of the set of peaks so defined is equivalent to a very significant reduction in the amount of information available relative to a given band for decision-making.
Figure 4:
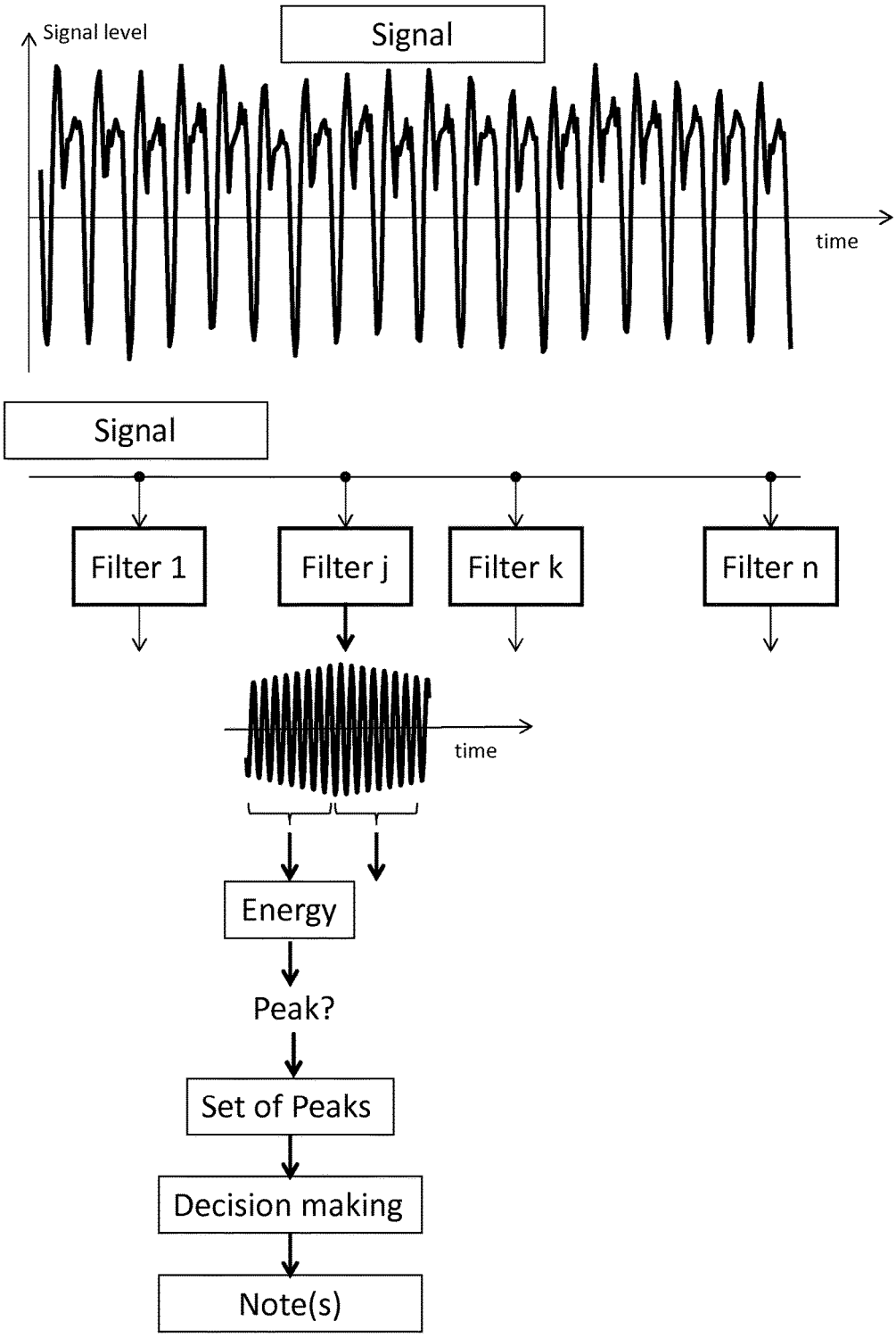
FIG. 4 describes the mechanism by which an input signal occupying a wide band of frequencies is split by a bank of band pass filters, generating at its outputs individual time sequences of signals confined to each individual band. It is common practice, in such implementations, to measure the signal energy present in each band over a given time interval, to characterize each band as a peak or non-peak exclusively on the basis of the energy measurement, and to address the process of decision-making solely on the base of the position in the frequency domain of the set of peaks so defined, which again is equivalent to a very significant reduction in the amount of information available for decision-making.
Figure 5:
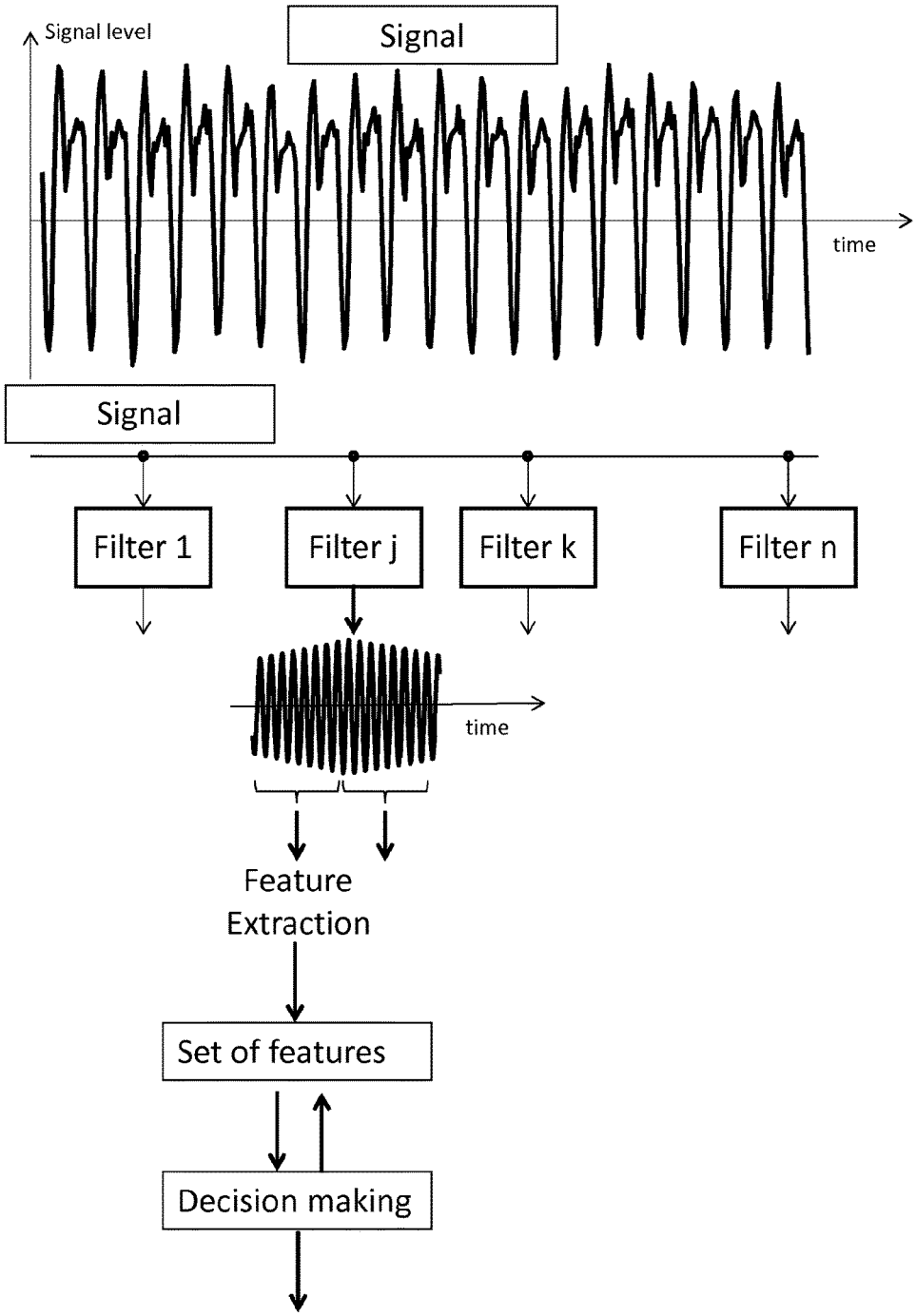
FIG. 5 describes the fundamental mechanism by which an input signal occupying a wide band of frequencies is split by a bank of band-pass filters, generating at its outputs individual time sequences of signals confined to each individual band, which are stored temporarily in order for a single feature or a plurality of features to be extracted from the signals being stored in memory, either in a fixed sequence or upon request from a decision-making algorithm. While accumulated energy in each band can obviously be calculated with such a scheme, it is equally possible to extract information-rich band-signal characteristics such as average values, variances, maximal and minimal values, local maxima and minima, signal envelopes, parameters of polynomial approximations, interpolated values, statistics of distances between observed or calculated zero crossings, etc.
Figure 6:
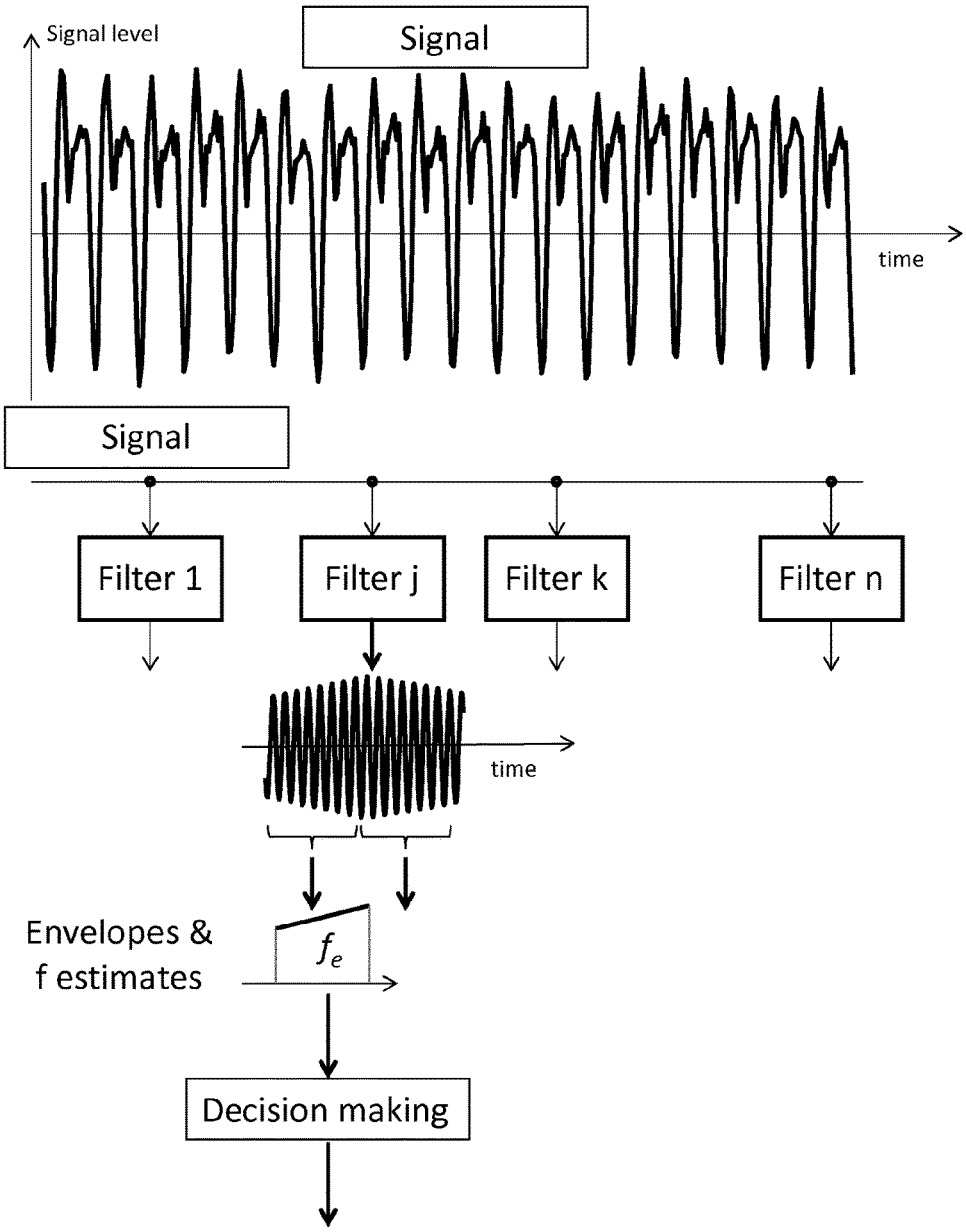
FIG. 6 describes a specific implementation of this mechanism in which a short segment of the time domain output of a given frequency band is processed in order to approximate its signal envelope and to extract a frequency measurement from the signal segment's zero crossings. In the case of a single spectral component with a quasi-stationary behaviour, the envelope will be flat, apart from a possible small fluctuation caused by noise. In the case where two spectral components are present in the band, the envelope will generally feature a distinct and measurable slope. In other words, detecting a segment of the envelope with a slope too large to have been caused by noise is a strong indication that more than one spectral line is present. On the other hand, an essentially flat envelope indicates either the presence of a single spectral component, or that of two or more spectral components the sum of which yields a short term maximum. Further information can be extracted from the statistics of the distances measured between zero crossings. Combining information from the envelope and from a frequency measurement can contribute to a more accurate estimation of the spectral component or components present within the band over the observation segment. The observation of subsequent segments will yield additional information, for example when the sum of two or more spectral components starts yielding the signal increasingly differing from the previous maximum. This simple and often very clear-cut distinction between the presence of one and that of several spectral components is not possible when peaks are only defined by the total energy present within a given band.
Figure 7:
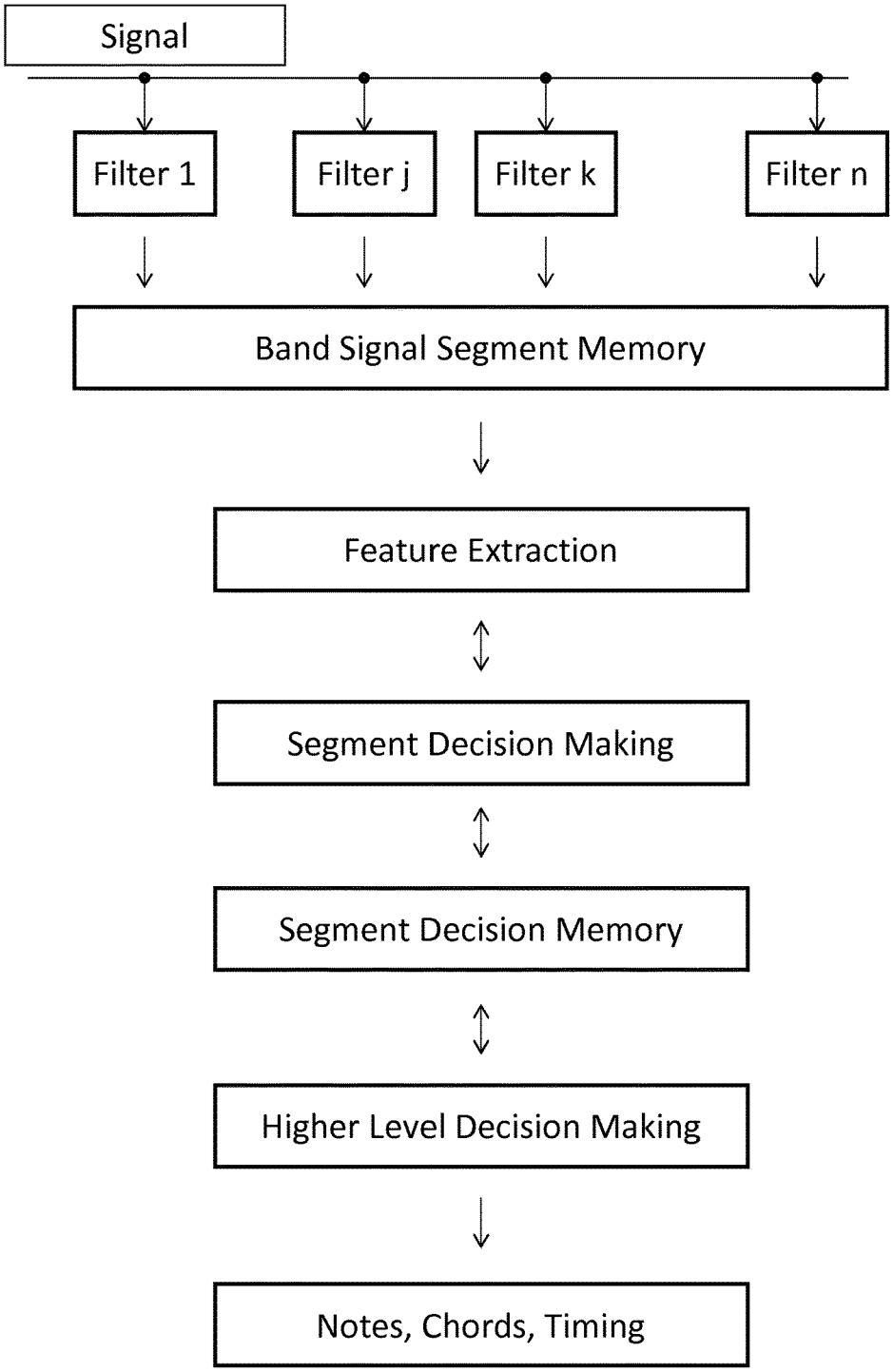
FIG. 7 describes the overall logical structure of a processor for implementing the invention. The input signal is split into narrow bands, and short-term segments are entered in a band segment signal memory. An algorithmic block for feature extraction can read the segments from memory and execute commands from a decision making algorithmic block requesting specific features. The segment decision making algorithmic block processes features from several short-term simultaneous segments from several bands. Features and decisions are stored short-term in a segment decision memory. A higher-level algorithmic block for decision making processes results from several short-term segments and several bands and outputs information on notes, their timing, and chords.

In the present invention, a set of narrow-band, time-domain signals is generated from the input signal via a band-pass filter bank, which itself can be implemented, as is well known to persons of the art, either by implementing the individual filters directly, or by performing at least one part of the processing via Fourier transformation. The resulting time-domain signals are temporarily stored, thus allowing for a pre-defined or a decision-dependent extraction of relevant features from the individual narrow-band time-domain signals. An early peak/non-peak decision based on energy average measurement is not performed.

Digital signal processing algorithms are installed which can extract specific features from the individual, narrow-band time-domain signals, such as, for illustration and not as an exhaustive list, by processing short-term statistics, signal envelopes, envelope-derived signal parameter estimates, and frequency measurements and their statistics.

The results of such signal processing allow a decision-making algorithm to reach tentative or final partial decisions concerning the non-occupancy, the ambiguous occupancy, and the single or multiple occupancy of individual frequency bands by spectral components, and also to represent the corresponding segments of band signals in terms of sets of parameters from signal models.

The decision-making algorithm requests a first set of features to be extracted from a set of time-domain band signals. Upon reception and processing of such features, the decision-making algorithm may require further features to be selectively extracted from some time-domain band signals, and the process of requesting features, processing the results, and possibly requesting further features can be repeated a number of times depending on the signal properties and the complexity of decision making.

It is clear to a person of the art that the time signals belonging to one particular decision interval can be stored exclusively for the duration of the decision interval, but also stored over consecutive several decision intervals, in order to confirm or infirm tentative decisions made over short periods of time. Similarly, it is also possible to store extracted features over several consecutive decision intervals.

It is also clear to a person of the art that, while the invention has been described within the scope of detecting notes on the basis of fundamentals and harmonics, it can equally be applied to the task of detecting multiple sounds which are not characterized by simple harmonic models, to the task of reliably detection the onset of musical notes, and to the task of extracting ongoing information relative to the tuning of the instrument.

It is further clear to a person of the art that the method of signal processing described in this invention can be implemented either offline on in real-time, and run on a general-purpose stationary or portable computer of sufficient processing power with the necessary built-in or external peripherals (for example a desktop computer or a notebook), a special-purpose stationary or portable device of sufficient processing power with the necessary built-in or external peripherals (for example a tablet or a smartphone), or a dedicated electronic device of sufficient processing power with the necessary built-in or external peripherals.

It is further clear to a person of the art that the individual functional blocks mentioned in this invention can be implemented in a plurality of ways, such as, in the sense of a list of illustrative examples and not as an exhaustive list, within separate signal processors or within a common one, using separate memory devices or common ones, and with code that can be either stored in a fixed form, or retrieved from an external code repository, or compiled locally on demand.

The invention claimed is:

1. A method for processing an original time-domain digital audio signal wherein said signal is split into a plurality of narrow-band time-domain digital audio signals confined to specific frequency bands, short-term segments of which are temporarily stored in memory, the method comprising:

using signal processing algorithms, extracting from said segments of said narrow-band time-domain signals, in a fixed sequence or upon request from a decision-making algorithm, one or more narrow-band time-domain features selected from a group of narrow-band time-domain features comprising instantaneous frequency or characteristics derived therefrom, instantaneous period or characteristics derived therefrom, instantaneous envelope or characteristics derived therefrom, and the time-domain positions of zero-crossings derived from sample values, directly or by interpolation, or characteristics derived therefrom, using said decision-making algorithm, making tentative or final decisions about a type of occupancy of frequency bands resulting from said narrow-band time-domain features, using said decision-making algorithm, requesting from said signal processing algorithms further specific feature extractions from specific short-term segments and makes tentative or final decisions about the type of occupancy of frequency bands resulting from the requested features, using said decision-making algorithm, storing the tentative and final decisions about band occupancy for processing together with results from later short-term segments, and using said decision-making algorithm, outputting final decisions derived from current and past short-term segments in the form of a set of notes having been played over some recent time interval, together with information relating to the timing of each note from the set.

2. The method according to claim 1, wherein said decision making also takes into account the short-term power of said original time-domain digital audio signal.

3. The method according to claim 1, wherein said decision making also takes into account restrictions on band occupancy patterns based on a priori knowledge that said time-domain digital audio signal originates from a specific musical instrument with specific physical restrictions in the simultaneous playing of specific sets of notes.

4. The method according to claim 1, wherein said decision making includes, in addition to identifying the frequency bands in which the fundamental frequencies of notes are detected, continuous segment-wise estimations of the actual fundamental frequencies of the notes that have been detected, the translation of such continuous segment-wise estimations of the actual fundamental frequencies into single-note tuning information, and the ability to output this single-note tuning information.

5. The method according to claim 1, wherein said decision making includes a specific recognition of note onsets, the extraction of onset-related timing information, the calculation of deviations in timing with respect to the timing of individual notes of a pre-defined reference sequence of single or multiple notes, and the ability to output such timing information and timing deviations.

6. The method according to claim 1, wherein said decision making also includes extracting, from single-note tuning information and a priori knowledge that said time-domain digital audio signal originates from a specific musical instrument, additional information on the tuning behavior of said instrument.

7. The method according to claim 1, wherein said decision making also includes extracting information for the purpose of adaptively improving the performance of the decision making algorithm.

8. An apparatus for processing a sequence of signals wherein an original time-domain digital audio signal is split into a plurality of narrow-band time-domain digital audio signals confined to specific frequency bands, short-term segments of which are temporarily stored, with physical elements including at least a processor and a memory allowing use of signal processing algorithms for:

extracting from said short-term segments one or more narrow-band time-domain features selected from a group of narrow-band time-domain features comprising instantaneous frequency or characteristics derived therefrom, instantaneous period or characteristics derived therefrom, instantaneous envelope or characteristics derived therefrom, and the time-domain positions of zero-crossings derived from sample values, directly or by interpolation, or characteristics derived therefrom, said extraction of said features taking place in a fixed sequence or upon request from a decision-making algorithm, then having said decision-making algorithm make tentative or final decisions about the type of occupancy of frequency bands resulting from said narrow-band time-domain features, then having said decision-making algorithm request from said signal processing algorithms further specific narrow-band time-domain features from specific short-term segments and make tentative or final decisions about the type of occupancy of frequency bands resulting from said requested features, said decision-making algorithm storing its tentative and final decisions about band occupancy in said memory for processing together with results from later short-term segments, and said processor further having said decision-making algorithm output final decisions derived from current and past short-term segments in the form of a set of notes having been played over some recent time interval, together with information as to the timing of each note from the set.

9. The apparatus according to claim 8, further comprising a microphone as the source of the original time-domain digital audio signal.

10. The apparatus according to claim 8, further comprising a display, and having said display visually represent the set of notes having been played over some recent time interval, together with information as to the timing of each note from the set.

* * * * *